United States Patent [19]

Alheid

[11] Patent Number: 4,728,396

[45] Date of Patent: Mar. 1, 1988

[54] METHOD OF OPERATING AND THREADING A COATER

[75] Inventor: Robert J. Alheid, Beloit, Wis.

[73] Assignee: Beloit Corp., Beloit, Wis.

[21] Appl. No.: 936,851

[22] Filed: Dec. 2, 1986

[51] Int. Cl.[4] ..... D21G 9/00; B05D 3/12

[52] U.S. Cl. ..... 162/193; 162/191; 162/265; 427/179; 226/91

[58] Field of Search ..... 427/179; 118/35, 37, 118/39, 40; 162/193, 191, 199, 255, 265; 226/91

[56] References Cited

U.S. PATENT DOCUMENTS

| | | | |
|---|---|---|---|
| 3,096,233 | 7/1963 | Rappaport et al. | 162/255 |
| 3,911,191 | 10/1975 | Guastella et al. | 427/179 |
| 4,648,942 | 3/1987 | Wanke et al. | 162/193 |

FOREIGN PATENT DOCUMENTS

| | | | |
|---|---|---|---|
| 554257 | 3/1958 | Canada | 162/193 |
| 560735 | 7/1958 | Canada | 162/193 |

*Primary Examiner*—S. Leon Bashore
*Assistant Examiner*—K. M. Hastings
*Attorney, Agent, or Firm*—Dirk J. Veneman; Raymond W. Campbell; David J. Archer

[57] ABSTRACT

A coater and a method of operating such coater is disclosed. The method of operating the coater includes the steps of separating a first tail from a full width web unwound from an unwind stand at threading velocity and threading the first tail at the threading velocity through a pull stack. The first tail is widened to the full width of the web so that a full width web extends through the pull stack. The full width web emerging from the pull stack is dumped into a first broke chute which is disposed below the pull stack. The full width web extending through the pull stack is accelerated along with a coating apparatus to coating velocity so that both the full width web and the coating apparatus attain coating velocity. A second tail is cut in the full width web between the unwind stand and the pull stack and such second tail is threaded through the coating apparatus while the second tail is moving at coating velocity. Meanwhile, the full width web less the second tail continues to be disposed to the first broke chute. The second tail is widened to full width so that a full width web extends through the coating apparatus and the full width web is then coated during passage through the coating apparatus. Finally, the coated web is reeled into a windup reel.

10 Claims, 18 Drawing Figures

METHOD OF OPERATING AND THREADING A COATER

BACKGROUND OF THE INVENTION

1. FIELD OF THE INVENTION

This invention relates to a coater and a method of operating such coater. More specifically, this invention relates to a coater and method of operating the same for applying a coating to a paper web.

INFORMATION DISCLOSURE STATEMENT

In the paper web coating art, numerous proposals have been set forth in order to improve the quality of the coated product and the speed with which the same may be produced. These coaters generally fall into two categories. The first category includes on-machine coaters and the second category includes off-machine coaters.

With on-machine coaters, paper is formed, pressed and dried and the dried web is often calendered to produce surface characteristics of the web which are compatible with the subsequent coating operation. The web emerging from the calender is fed into a coating apparatus which may include coating applicator rolls or may include a short-dwell coating arrangement. With these on-machine coaters, the web passes through the coating apparatus at substantially the same velocity as the velocity of the web emerging from the calender.

In the past, when paper webs were manufactured, such webs would emerge from the calender at speeds of approximately 2,000 feet per minute or less and the feeding of such web at 2,000 feet per minute through a subsequent coating apparatus presented relatively few problems. However, today paper machines are approaching velocities of 4,000 or more feet per minute and while many coaters are capable of handling and coating webs at such high velocities, a problem has existed, particularly when attempting to coat relatively thin webs such as lightweight coated webs and the like.

Often when coating such lightweight grade webs at high velocity it has been deemed advisable to coat these lightweight webs on off-machine coating apparatus.

Off-machine coaters, as the name implies, involve winding the web from the calendering process onto a reel and then transporting the wound reel to an unreeling station where such web is unwound and fed at an acceptable coating velocity through the coating apparatus. It is evident that with the ever increasing speed with which webs are produced on papermaking machines, that off-machine coaters will continue to be used more extensively.

When coating with an off-machine coater, the coater does not have to operate at the same speed as the paper machine that produced the web. However, in order to maintain an acceptable coating production rate, the coater must operate at coating velocities generally higher than the velocity of the web being produced by the papermaking machine. Usually the coating operation in an off-machine coater includes unwinding the paper web from an unwind stand and then manually tearing from the web a first tail which is reinforced. This first tail is then threaded at low speed threading velocity through a pull stack. The first tail is then fed at low threading velocity through the coating apparatus. When the first tail has been threaded through the coating apparatus using cooperating threading ropes or the like, the tail is progressively widened between the unwind stand and the pull stack until a full width web extends through the coating apparatus. Next, the unwind stand, pull stack and coating apparatus are simultaneously accelerated from the low threading velocity to high-speed coating velocity which may be as high as 4,000–5,000 feet per minute. When coating velocity has been attained, coating of the web extending through the coating apparatus begins. It is not uncommon in a practical operation of such an off-machine coater to experience eight (8) or more web breakages during a twenty-four (24) hour production period. Each time a breakage occurs, such breakage is detected and an emergency signal is generated resulting in an immediate shutdown of the entire coater apparatus including unwind stand, pull stack and coating apparatus. Every time a breakage occurs, the web must be threaded at low threading velocity through the coating apparatus as mentioned hereinbefore. In practice, the ratio of web breakages in the coating apparatus relative to the number of breakages occuring between the unwind stand and the pull stack are in the region of 20 to 1. Each time the web breaks, the entire coating production line must be stopped and the rethreading operation may take 25–50 minutes to complete from the time of the emergency stop to the time that coating production is resumed. Because of the occurence of such numerous breakages in the coating apparatus, in order to keep up with the supply of paper being produced by the papermaking machine, it is necessary for the coater to operate at speeds greatly in excess of the production speeds of the corresponding papermaking machine. Alternately, it has been found necessary to interrupt the production on the papermaking machine while the off-machine coater endeavors to catch up with the paper produced by the papermaking machine. Clearly, such interruption or reduction in speed of the papermaking machine is not desirable or commercially economical.

The present invention is directed to the problems associated with the lost production of coated product due to the time-consuming operation of starting up a coater and rethreading the coating apparatus subsequent to a web breakage. The present invention basically envisages dumping the full width web between the pull stack and the coating apparatus following a breakage in the coating apparatus while maintaining the coating apparatus at coating velocity. A second threading tail is cut in the full width web between the unwind stand and the pull stack and this narrow second tail is threaded at coating velocity through the coating apparatus. This rethreading of the coating apparatus at coating velocity can, in many instances, be accomplished in less than one minute. It will be evident to those skilled in the art that although during the aforementioned rethreading operation, a full width web less the narrow tail portion will be dumped into the broke chute for approximately one minute, this loss of paper is far more economical than the loss in production resulting from the prior art practice of stopping the coater and rethreading the web by a low velocity threading operation which, as stated hereinbefore, takes between 25–50 minutes.

The present invention seeks to overcome the aforementioned problems and disadvantages associated with the prior art proposals for slow speed rethreading subsequent to a breakage and provides a method of coating and a coater therefor that provides a significant contribution to the coating art.

An object of the present invention is the provision of a method of operating a coater which includes separating a first tail from a full width web unwound from an unwind stand at threading velocity, threading the first tail at the threading velocity through a pull stack and subsequently widening the first tail to the full width of the web so that a full width web extends through the pull stack.

Another object of the present invention is the provision of a method of operating a coater which includes dumping the full width web emerging from the pull stack into a first broke chute disposed below the pull stack. The full width web and the coating apparatus are then accelerated to coating velocity so that both the full width web and the coating apparatus attain coating velocity.

Another object of the present invention is the provision of a method of operating a coater in which a second tail is cut in the full width web between the unwind stand and the pull stack and such second tail is threaded through the coating apparatus while the second tail is moving at coating velocity and the remainder of the full width web is disposed of into the first broke chute.

Another object of the present invention is the provision of a method of operating a coater which includes widening the second tail extending through the coating apparatus to full width and then coating the full width web during passage through the coating apparatus and subsequently reeling the coated web onto a windup reel.

Another object of the present invention is the provision of a method of operating a coater which includes operating a first cutter to cut a second narrow tail portion between the unwind stand and the pull stack and widening this second narrow tail portion to the full width of the web subsequent to rethreading of the coating apparatus.

Another object of the present invention is the provision of a method of operating a coater in which subsequent to a web breakage between the pull stack and the reeling of the coated web onto a windup reel, the unwind stand, the pull stack and the coating apparatus are maintained at coating velocity. The full width web emerging from the pull stack is dumped into the first broke chute. A second narrow tail portion is cut from the full width web between the unwind stand and the pull stack and such second narrow tail portion is threaded at coating velocity through the coating apparatus while the remainder of the full width web is dumped into the first broke chute. When the second narrow tail portion has been threaded through the coating apparatus, the second narrow tail portion is widened to the full web width such that a full web width extends through the coating apparatus after which coating of the web is resumed.

Another object of the present invention is the provision of a coater for coating a web including an unwind stand and a pull stack. The apparatus also includes a first broke chute disposed below the pull stack so that after threading a first tail through the pull stack at threading velocity, the full width web can be dumped in the first broke chute. Next, a second tail portion is cut from the full width web and threaded at coating velocity through the coating apparatus.

Other objects and advantages of the present invention will be apparent to those skilled in the art by a consideration of the detailed description contained hereinafter taken in conjunction with the annexed drawings and from a consideration of the disclosure of the appended claims.

SUMMARY OF THE INVENTION

The present invention includes a method of operating a coater and a coater for carrying out this operation. More particularly, this invention relates to a coater and method of operating the same for coating a paper web. The method includes the steps of separating a first tail from a full width web unwound from an unwind stand at threading velocity and threading the first tail at the threading velocity through a pull stack. The first tail is widened to the full width of the web so that a full width web extends through the pull stack. The full width web emerging from the pull stack is dumped into a first broke chute which is disposed below the pull stack. The full width web extending through the pull stack is accelerated and the coating apparatus is accelerated to coating velocity so that both the full width web and the coating apparatus attain coating velocity. A second tail is cut in the full width web between the unwind stand and the pull stack and this second tail is threaded through the coating apparatus while the second tail is moving at coating velocity. Meanwhile, the full width web less the second tail continues to be disposed of into the first broke chute. Subsequent to threading at coating velocity the second tail is widened to full width so that a full width web extends through the coating apparatus. Finally, the full width web is coated during passage through the coating apparatus and the coated web is reeled onto a windup reel.

In a more specific method of operating the coater, the step of separating the first tail also includes manually tearing a first narrow tail portion from the full width web being unwound from the unwind stand. The first narrow tail has a first and second side edge, the first and second side edges being disposed parallel relative to each other with the edges extending in a machine direction for facilitating threading of the first tail through the pull stack.

The step of threading the first tail also includes inserting the first narrow tail portion of the first tail into a first nip defined by cooperating rolls of the pull stack such that when the cooperating rolls of the pull stack are rotating at threading velocity, the first narrow tail portion is threaded through the pull stack.

The step of widening the first tail also includes widening the first tail progressively until a full width web extends through the pull stack. The first widening portion of the first tail is disposed between the first narrow tail portion and the full width web.

The step of dumping the full width web also includes returning the dumped web for repulping.

The step of accelerating the full width web also includes accelerating the unwind stand and the pull stack such that the full width web emerging from the pull stack and being dumped is accelerated rapidly to coating velocity. Also, the coating apparatus accelerates rapidly to coating velocity so that the coating apparatus attains a coating velocity which is the same velocity as that of the full width web being dumped.

The step of cutting the second tail also includes operating a first cutter which is disposed between the unwind stand and the pull stack such that the first cutter cuts a second narrow tail portion from the full width web being dumped. The second narrow tail portion has laterally-spaced parallel third and fourth edges for facilitating threading of the second narrow tail portion into the coating apparatus.

The step of threading the second tail also includes feeding the second tail between cooperating threading ropes of the coating apparatus such that the second tail which is generated between the unwind stand and the pull stack at coating velocity is fed between the ropes. The second tail is threaded at coating velocity through the coating apparatus and the second tail is fed through the coating apparatus while the full width web less the second tail is dumped into the first broke chute.

The step of widening the second tail also includes moving the first cutter in a cross-machine direction such that as the full width web moves relative to the first cutter, the second narrow tail portion progressively widens until a full width web extends through the coating apparatus. The third edge of the second widening portion is disposed in a machine direction and a fifth edge thereof is disposed diagonally relative to the third edge with the second widening portion being disposed between the second narrow tail portion and the full width web.

In an alternative embodiment of the present invention, the step of widening the second tail also includes moving the first cutter in a cross-machine direction such that a second narrow tail portion progressively widens until a full width web extends through a first section of the coating apparatus. The full width web emerging from the first section is dumped into a second broke chute and a third tail is cut from the full width web between the first section and the second broke chute. The third tail is fed at coating velocity through a downstream second portion of the coating apparatus.

The present invention also includes a coater for coating a web—the coater including an unwind stand for unwinding the web to be coated and a pull stack disposed downstream relative to the unwind stand. A first broke chute is disposed below the pull stack such that when a first tail manually separated between the unwind stand and the pull stack has been threaded through the pull stack and the first tail has been widened to provide a full width web extending through the pull stack, the full width web emerging from the pull stack is dumped into the first broke chute. The coating apparatus is accelerated along with the unwind stand and the pull stack together with the full width web to coating velocity such that the web being dumped to the first broke chute attains the same coating velocity as the coating apparatus. Finally, a first cutter disposed between the unwind stand and the pull stack cuts a second tail from the full width web emerging from the pull stack such that the second tail is fed through the coating apparatus at coating velocity. The first cutter moves relative to the web upstream relative to the coating apparatus so that the second tail is widened enabling a full width to extend through the coating apparatus at coating velocity. This arrangement avoids the necessity of threading the web at threading velocity through the coating apparatus. Such threading at threading velocity has inherently resulted in a loss of production during a coating operation.

The present invention also provides a method of rethreading a web through a coating apparatus subsequent to a break occuring in the web between the pull stack and the reeling of the coated web. This rethreading operation includes the steps of maintaining the unwind stand, the pull stack and the coating apparatus at coating velocity. The full width web emerging from the pull stack is dumped into the first broke chute. A second narrow tail portion is cut from the full width web between the unwind stand and the pull stack and this second narrow tail portion moving at coating velocity is threaded through the coating apparatus at coating velocity while the remainder of the full width web is dumped into the first broke chute. When the second narrow tail portion has been threaded through the coating apparatus, the second narrow tail portion is widened out to the full width of the web such that a full width web extends through the coating apparatus. In this way, when the full width web has been rethreaded through the coating apparatus at coating velocity, coating of the full width web i resumed.

Although the present invention is particularly useful in increasing the production rate of an off-machine coater for coating a paper web, it will be evident to those skilled in the art that the method and apparatus of the present invention should not be limited to an off-machine coater for coating paper webs. Rather, the present invention envisages many modifcations and variations of the basic concept as disclosed herein. These variations and modifications do not depart from the spirit and scope of the invention as defined by the appended claims and include coating of a web of any type material.

BRIEF DESCRIPTION OF THE DRAWINGS

FIG. 14 also shows the second narrow tail portion being threaded at coating velocity into and through the coating apparatus while the remainder of the full width web is dumped into the first broke chute.

Similar reference characters refer to similar parts throughout the various embodiments of the present invention.

DETAILED DESCRIPTION OF THE DRAWINGS

Figure 1:
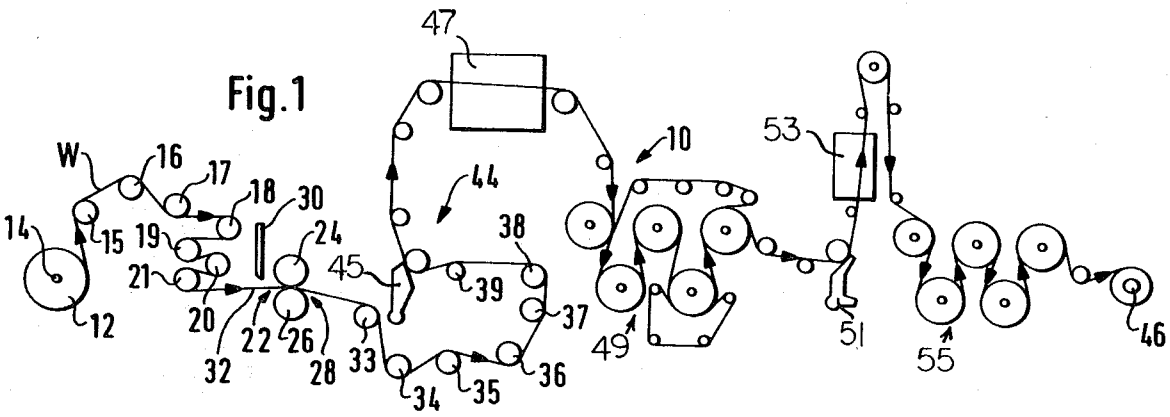
FIG. 1 is side-elevational view of a typical prior art off-machine coater in which subsequent to a web breakage in the coating apparatus, the whole coater is stopped and the coating apparatus is rethreaded at slow threading velocity.

FIG. 1 is a side-elevational view of a typical prior art off-machine coater 10 having an unwind reel 12 rotatably supported by an unwind stand 14. A full width web W is guided by a plurality of guide rolls 15,16,17,18,19,20 and 21 such that the web W is guided towards a first nip 22 defined between a first and second roll 24 and 26 respectively of a pull stack generally designated 28. A first narrow tail portion 32 is manually torn from the web between the unwind stand 14 and the pull stack 28 as well known in the art as described hereinafter. This enables threading of the first narrow tail portion 32 through the pull stack 28, the tail portion 32 having been cut by cutter 30. When the narrow tail portion 32 has been threaded through the pull stack 28 at threading velocity, the first tail portion 32 emerging from the pull stack 28 is fed at low threading velocity past a plurality of guide rolls 33,34,35,36,37,38 and 39. This first tail 32 is fed between cooperating threading ropes extending around a coating apparatus generally designated 44 as is well known in the art. With the coating apparatus 44 rotating at slow threading velocity, the first narrow tail portion 32 is guided through the coating apparatus 44 and when this has been accomplished, the first narrow tail portion 32 is widened out to the full width of the web W. When the first tail portion 32 has been widened to the full width of the web W, the full width of the web W enter and extends through the coating apparatus 44 and the unwind stand 14, the pull stack 28 and the coating apparatus 44 are then accelerated up to coating velocity after which coating of the web W may be commenced. The coating apparatus 44 typically includes a first coater 45, a first dryer 47 which may be of the impingement type, a first dryer section 49, a second coater 51, a second dryer 53 followed by a second dryer section 55 so that both sides of the web are coated and dried.

The aforementioned starting up operation associated with such prior art off-machine coaters may take in the region of 25–50 minutes to accomplish. Furthermore, in the event of the web W breaking somewhere between the pull stack 28 and a rewind drum 46 the following rethreading sequence has previously been employed. First, the web breakage is detected and an emergency signal is generated such that the unwind stand 14, the pull stack 28 and the coating apparatus 44 rapidly decelerate to a standstill. The broken web remaining within the coating apparatus 44 is removed by the use of high-powered water jets or the like. Next, another tail portion 32 is cut from the web W so that this tail portion emerges from the pull stack 28 at low threading velocity. This further first narrow tail portion 32 is threaded into the coating apparatus 44 while the coating apparatus 44 is rotated at the low threading velocity. As the threading ropes thread the narrow first tail portion 32 through the length of the coating apparatus 44 at low threading velocity, the first tail 32 is widened to full width such that the full width web W is threaded at threading velocity through the coating apparatus 44. This rethreading operation similarly may take on the average, 25–50 minutes to accomplish. It is not uncommon in the operation of off-machine coaters to experience at least 8 web breakages in the course of any 24 hour coating production operation. The loss in production resulting from the time taken to start up such off-machine coater taken in conjunction with the additional excessive loss of production resulting from numerous web breakages has resulted in a coating operation in the prior art proposals that has proven to be less than desirable.

According to the present invention, a method of operating a coater is provided that not only increases coating production rates from startup of the coating operation, but also increases production rates when a breakage occurs between the pull stack and the rewind drum.

Method of operating the coater when starting up coater

Figure 2:
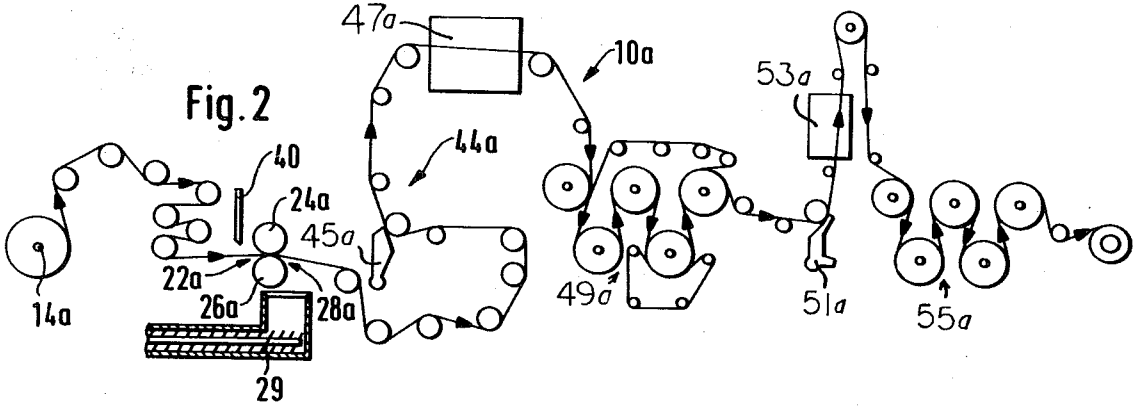
FIG. 2 is a side-elevational view of the off-machine coater of the present invention showing the first cutter between the unwind stand and the pull stack and with a broke chute disposed below the pull stack.

FIG. 2 shows a coater 10*a* of the present invention having an unwind stand 14*a*, a pull stack 28*a*, a first broke chute 29, a first cutter 40 and a coating apparatus generally designated 44*a*.

FIGS. 3 to 12 show the steps used in operating this coater 10*a*. These operational steps are shown sequentially in FIGS. 3 to 12 to show each step of the starting up coating operation.

FIGS. 3 to 12 are top plan views of the coater shown in FIG. 2.

Figure 3:
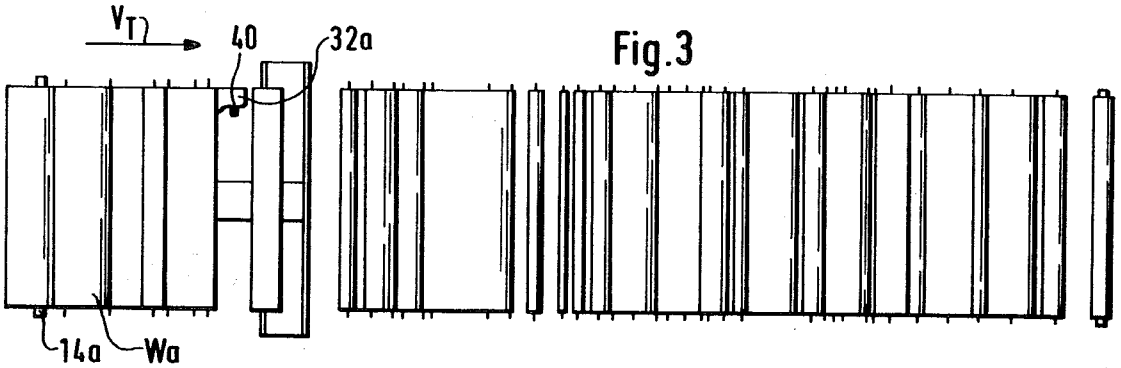
FIG. 3 is a top plan view of the apparatus shown in FIG. 2 illustrating the manual separating of a first tail from the web.

FIG. 3 shows the manual separating of a first narrow tail portion 32*a* from a full width web Wa unwound from an unwind stand 14*a* at threading velocity indicated by the arrow Vt.

Figure 4:
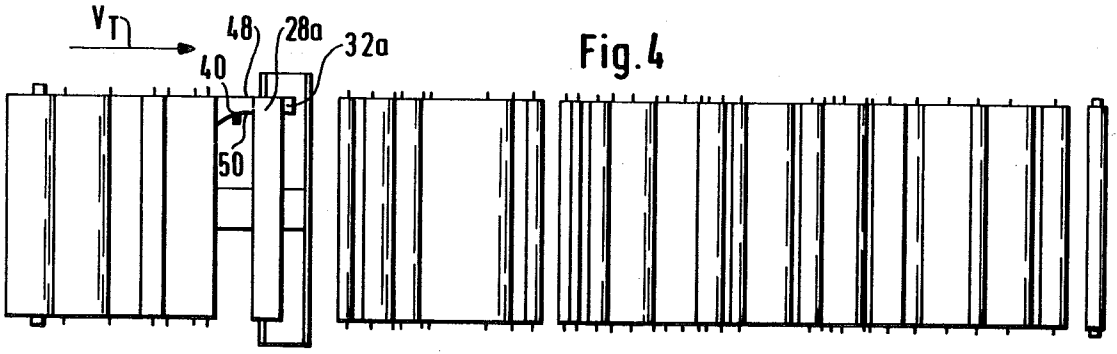
FIG. 4 is a similar view to that shown in FIG. 3 but with the first tail being threaded through the pull stack at threading velocity.

FIG. 4 shows the first narrow tail portion 32*a* being threaded at threading velocity Vt through the pull stack 28*a*.

Figure 5:
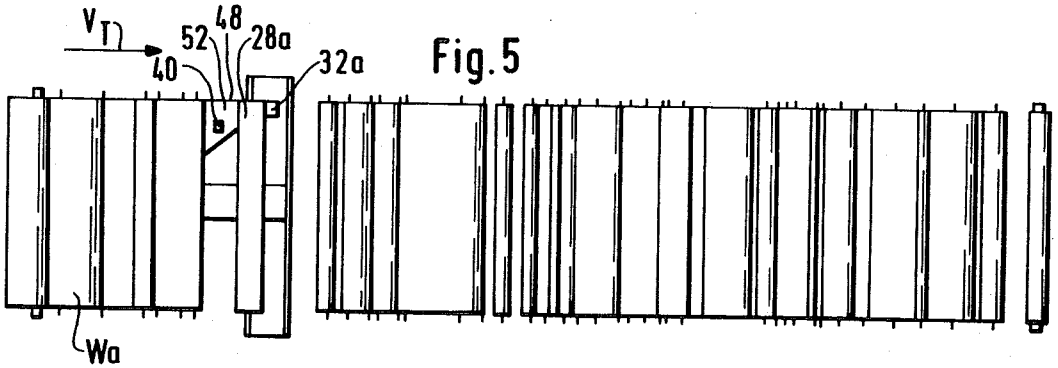
FIG. 5 is a similar view to that shown in FIG. 3 but shows the first tail being progressively widened to full width so that a full width web will extend through the pull stack.

FIG. 5 shows the first narrow tail portion 32a being widened to the full width of the web Wa so that a full width web Wa extends through the pull stack 28a.

Figure 6:
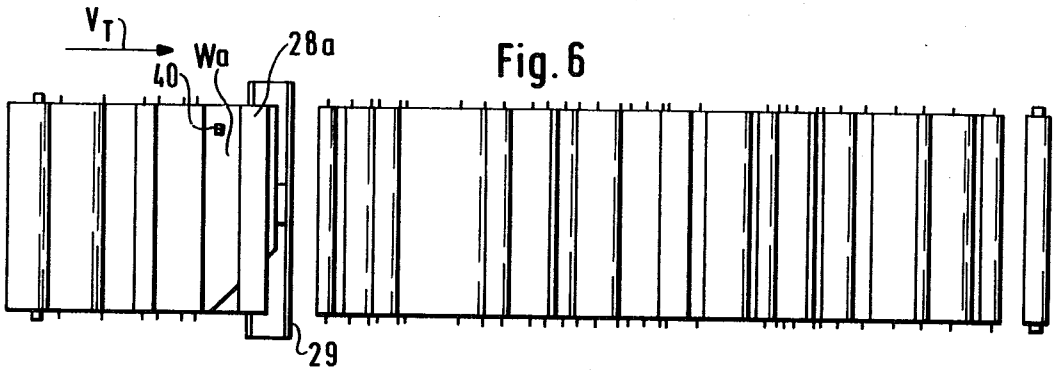
FIG. 6 shows the first widening portion of the web extending through the pull stack.

FIG. 6 shows the full width web Wa emerging from the pull stack 28a and being dumped into the first broke chute 29 which is disposed below the pull stack 28a.

Figure 7:
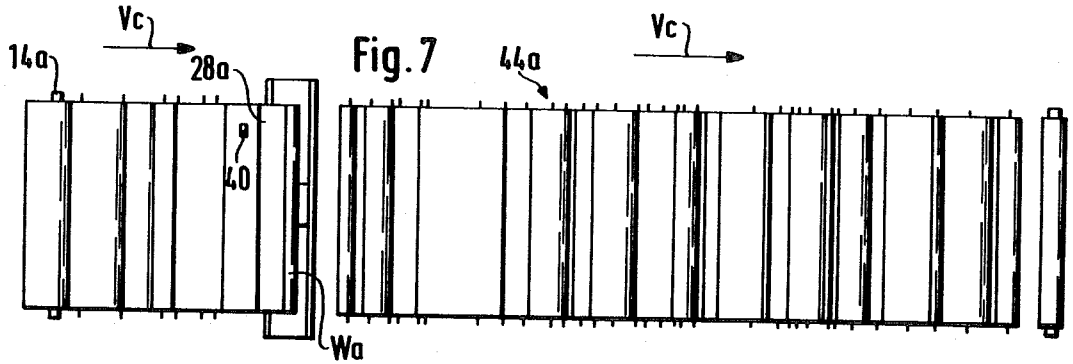
FIG. 7 is a similar view to that shown in FIG. 6 but shows the full width web emerging from the pull stack being dumped into the first broke chute and the full width web and coating apparatus having been accelerated to coating velocity.

FIG. 7 shows the unwind stand 14a, the pull stack 28a, and the coating apparatus 44a having been accelerated to coating velocity as indicated by the arrows Vc such that the full width web Wa extending through the pull stack 28a moves at the coating velocity Vc while the coating apparatus 44a also moves at this same coating velocity Vc.

Figure 8:
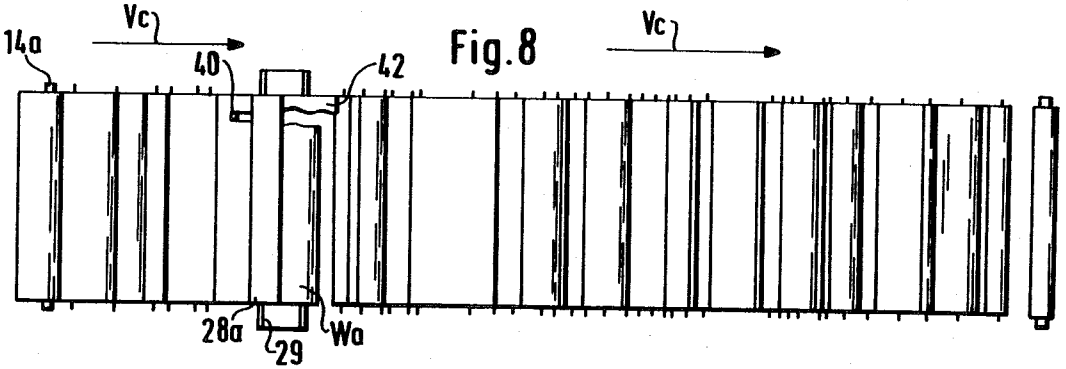
FIG. 8 is a similar view to that shown in FIG. 7 but shows a second tail being cut from the full width web.

FIG. 8 shows a first cutter 40 cutting a second narrow tail portion 42 in the full width web Wa between the unwind stand 14a and the pull stack 28a.

Figure 9:
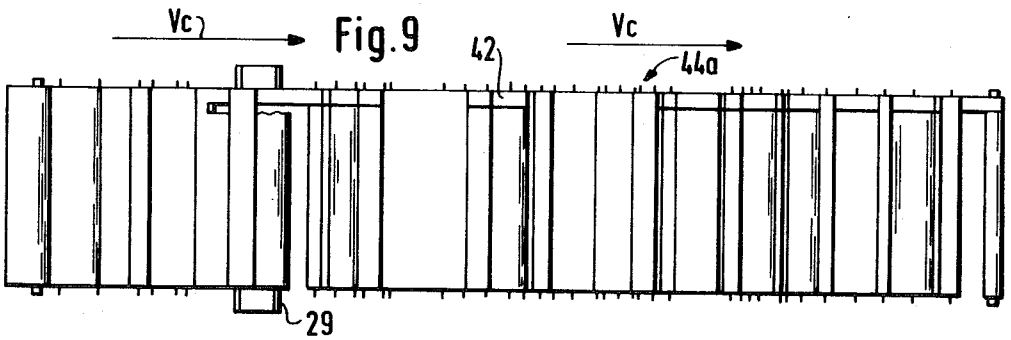
FIG. 9 is a similar view to that shown in FIG. 8 but shows the second tail being fed into and through the coating apparatus at coating velocity while the remainder of the full width web is being dumped to the first broke chute.

FIG. 9 shows the second narrow tail portion 42 being threaded through the coating apparatus 44a while the second tail 42 is moving at coating velocity Vc and while the remainder of the full width web, that is the full width web Wa less the second narrow tail portion 42, continues to be disposed into the first broke chute 29.

Figure 10:
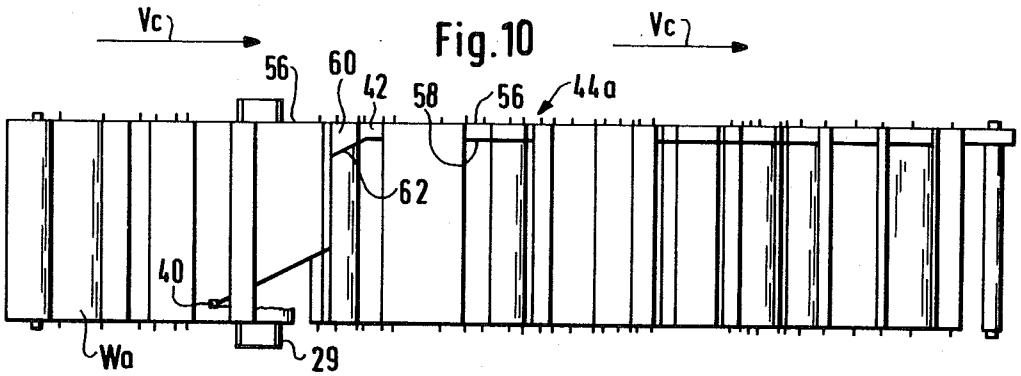
FIG. 10 is a similar view to that shown in FIG. 9 but shows the second tail being widened to the full width of the web such that the full width web will extend through the coating apparatus.

FIG. 10 shows the second narrow tail portion 42 being widened by lateral movement of the first cutter 40 to obtain a full width web Wa so that a full width web Wa is guided into and through the coating apparatus 44a.

Figure 11:
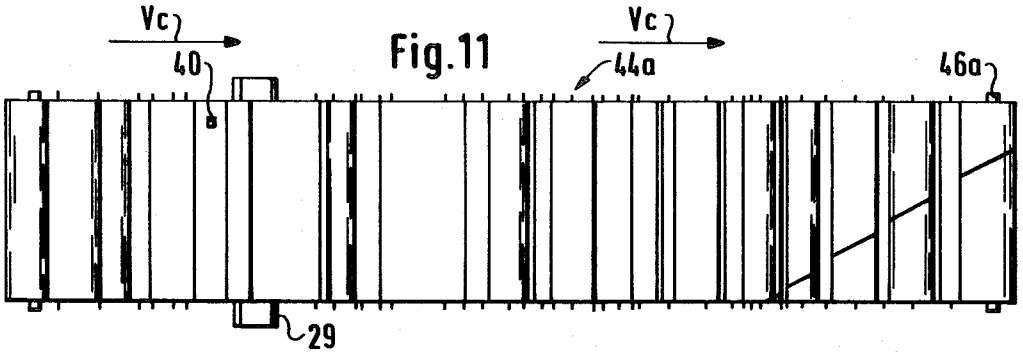
FIG. 11 is a similar view to that shown in FIG. 10 and shows the full width web extending through most of the coating apparatus.

When the full width web extends through the coating apparatus 44a, the full width web Wa begins to be wound onto the rewind drum 46a as shown in FIG. 11.

Figure 12:
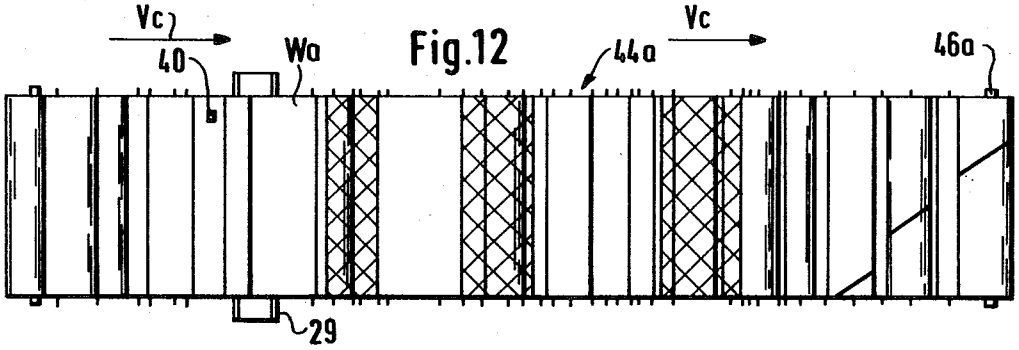
FIG. 12 is a similar view to that shown in FIG. 11 showing the coating operation as having been resumed.

As shown in FIG. 12, coating of the web as indicated by the double cross hatching is commenced.

Rethreading the coating apparatus after a web breakage between the pull stack and the windup reel Usually, when a break occurs during a coating operation, such breakage of the web Wa occurs during passage of the web Wa through the coating apparatus 44a. Although web breakages occasionally occur between the unwind stand 14a and the pull stack 28a, the ratio of breakages between the pull stack 28a and windup reel or rewind drum 46a to the number of breakages between the unwind stand 14a and the pull stack 28a falls within the ratio of 20 to 1. When a web breakage occurs, the following sequence of steps, as illustrated by FIGS. 13 to 17 are implemented in order to rethread the coating apparatus 44a and to return to the coating mode.

FIGS. 13 to 17 are top plan views of the coating apparatus 44a shown in FIG. 2 showing the sequence in the rethreading operation.

Figure 13:
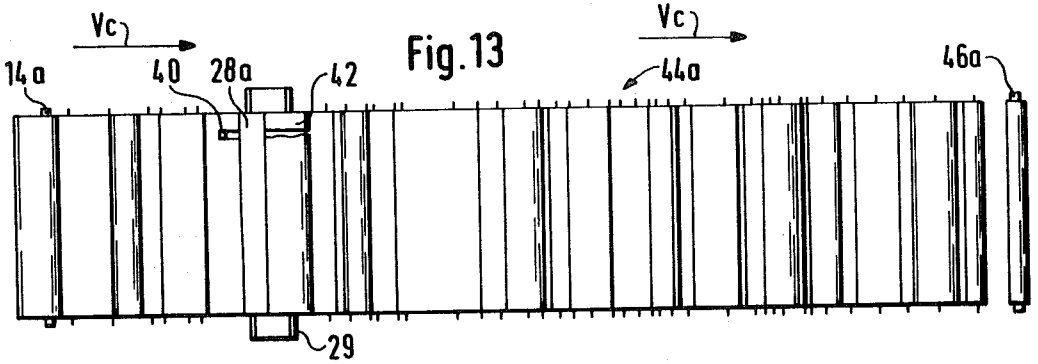
FIG. 13 is a similar view to that shown in FIG. 3 but shows the first step in a sequence of operations subsequent to a web breakage occuring between the pull stack and the windup reel, FIG. 13 showing the unwind stand, the pull stack and the coating apparatus continuing to rotate at coating velocity with the broken full width web being dumped into the first broke chute.

FIG. 13 shows how when a web breakage occurs between the pull stack 28a and the windup reel 46a the unwind stand 14a, the pull stack 28a and the coating apparatus 44a are maintained at coating velocity Vc. FIG. 13 also shows the full width web emerging from the pull stack being directed downwardly into the first broke chute 29 and the first cutter 40 beginning to cut a second tail 42.

Figure 14:
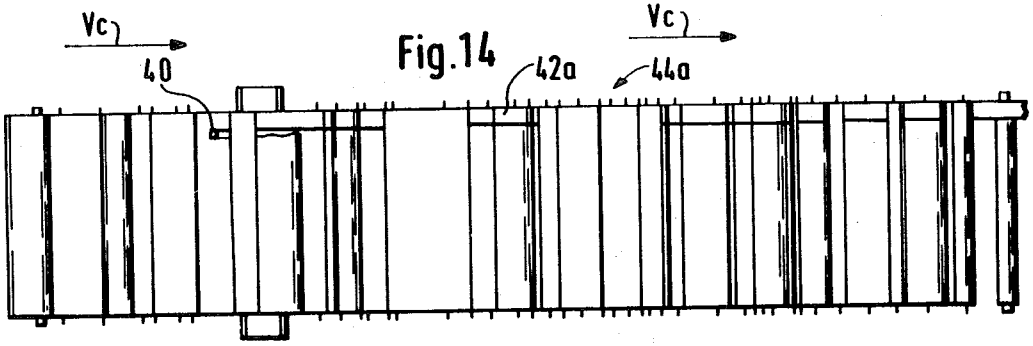
FIG. 14 is a similar view to that shown in FIG. 13 but shows the second step of cutting a second narrow tail portion from the full width web between the unwind stand and the pull stack.

FIG. 14 shows the first cutter 40 continuing to cut a second narrow tail portion 42 from the full width web and directing the second tail 42 through the coating apparatus 44a rotating at coating velocity Vc.

Figure 15:
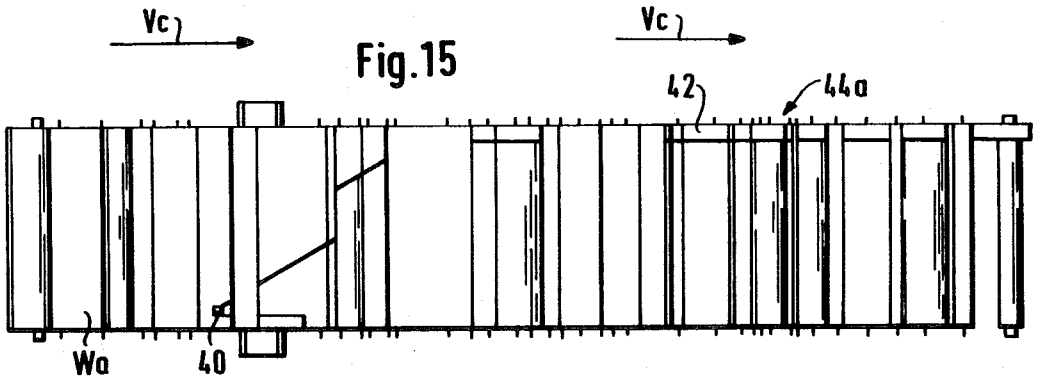
FIG. 15 is similar to that shown in FIG. 14 but shows the second narrow tail portion being widened to full width such that a full width web may extend through the coating apparatus at coating velocity.

FIG. 15 shows the first cutter 40 moving sideways relative to the second narrow tail portion 42 so that the second tail 42 widens to a full width web Wa such that the full width web extends through the coating apparatus 44a moving at coating velocity Vc.

Figure 16:
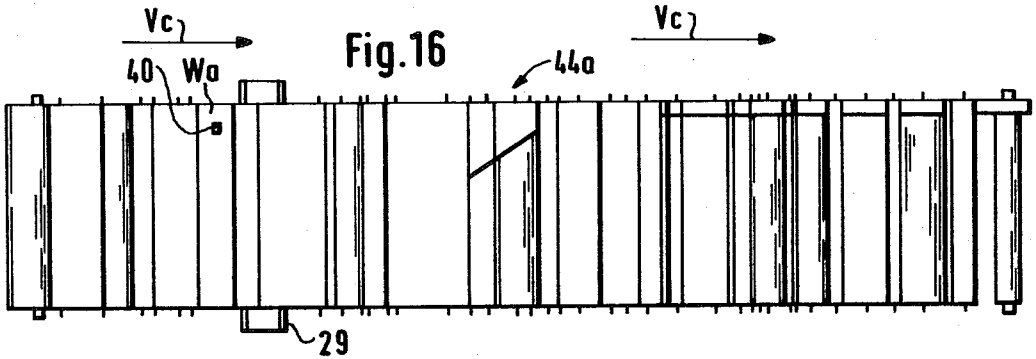
FIG. 16 is a similar view to that shown in FIG. 15 but shows the full width web beginning to extend through the coating apparatus.

FIG. 16 shows the full width web Wa beginning to extend through the coating apparatus 44a.

Figure 17:
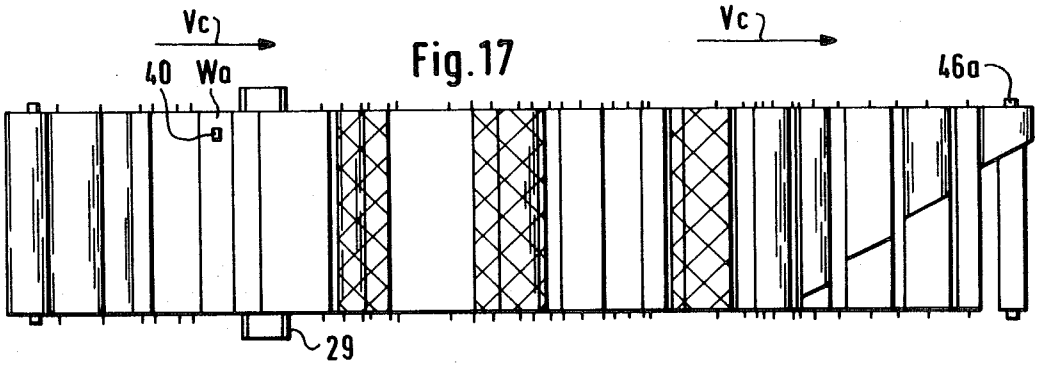
FIG. 17 shows the resumption of the coating of the rethreaded web extending through the coating aparatus.

FIG. 17 shows the coating of the full width web as having been resumed as indicated by the double cross hatching and the coated web being reeled onto the windup reel 46a.

In both of the aforementioned operations for starting the coating operation and for rethreading the web after a web breakage, the second tail 42 is threaded through the coating apparatus 44a at coating velocity Vc thereby avoiding the time-consuming prior art practice of threading the tail through the coating apparatus at threading velocity Vt and thereafter accelerating the entire coater up to coating velocity Vc.

More specifically, as shown in FIGS. 3 to 17 the step of separating the first tail 32a also includes manually tearing a first narrow tail portion 32a from the full width web Wa as the full width web Wa is unwound from the unwind stand 14a. The first narrow tail 32a as shown in FIG. 4 has a first and second side edge 48 and 50 respectively disposed parallel relative to each other and extending in a machine direction for facilitating threading of the first tail 32a through the pull stack 28a.

The step of threading the first tail 32a as illustrated in FIGS. 3 to 7 also includes inserting the first narrow tail portion 32a of the first tail into a first nip 22a defined by cooperating rolls 24a and 26a of the pull stack 28a such that when the cooperating rolls 24a and 26a of the pull stack 28a are rotating at threading velocity Vt the first narrow tail portion 32a is threaded through the pull stack 28a.

The step of widening the first tail 32a as illustrated in FIGS. 3 to 7 also includes progressively widening the first tail 32a until a full width web Wa extends through the pull stack 28a. The first widening portion 52 of the first tail 32a as shown in FIG. 5, is disposed between the first narrow tail portion 32a and the full width web Wa. The first widening portion 52 has its first edge 48 disposed in a machine direction.

The step of dumping the full width web Wa as shown in FIGS. 7 to 9 and 13 to 15 also includes returning the dumped web for repulping.

The step of accelerating the full width web Wa as shown in FIG. 7 also includes accelerating the unwind stand 14a and the pull stack 28a such that the full width web Wa emerging from the pull stack 28a and being dumped, is accelerated rapidly to coating velocity Vc. Also, the coating apparatus 44a is rapidly accelerated to coating velocity Vc so that the coating apparatus 44a attains a coating velocity Vc which is the same velocity as that of the full width web being dumped.

The step of cutting the second tail as illustrated in FIGS. 8 to 10 and 13 to 15 also includes operating a first cutter 40 which is disposed between the unwind stand and the pull stack 28a such that the first cutter 40 cuts a second narrow tail portion 42 from the full width web Wa being dumped. The second narrow tail portion 42 as shown in FIG. 10 has laterally-spaced parallel third and fourth edges 56 and 58 respectively for facilitating threading of the second narrow tail portion 42 into the coating apparatus 44a.

The step of threading the second tail 42 as illustrated in FIGS. 9, 10, 14 and 15 also includes feeding the second tail 42 between cooperating threading ropes of the coating apparatus 44a such that the second tail 42 which is generated between the unwind stand and the pull stack 28*a* at coating velocity Vc is fed between the ropes and is threaded at coating velocity Vc through the coating apparatus 44*a*. The second tail 42 is fed through the coating apparatus 44*a* while the full width web less the second tail 42 is dumped into the first broke chute 29.

The step of widening the second tail 42 as illustrated in FIGS. 10, 14 and 15 also includes moving the first cutter 40 in a cross-machine direction such that as the full width web moves relative to the first cutter 40, the second narrow tail portion 42 progressively widens until a full width web extends through the coating apparatus 44*a*. The third edge 56 of the second widening portion 60 as shown in FIG. 10 is disposed in a machine direction and a firth edge 62 is disposed diagonally relative to the third edge 56 with the second widening portion 60 being disposed between the second narrow tail portion 42 and the full width web Wa.

Figure 18:
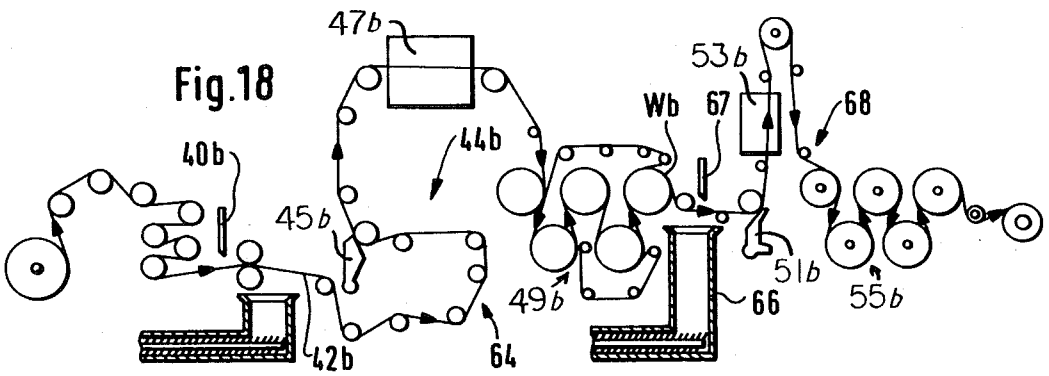
FIG. 18 is a side-elevational view of a further embodiment of the present invention in which the coating apparatus includes a first and a second section with a second broke chute being disposed between the first and second sections permitting a full width web emerging from the first section to be dumped into the second chute while a third tail is cut therefrom by a second cutter for threading through the second section of the coating apparatus.

In an alternative embodiment of the present invention as illustrated in FIG. 18, the step of widening the second tail also includes moving the first cutter 40*b* in a cross-machine direction such that the second narrow tail portion 42*b* progressively widens until a full width web Wb extends through a first section 64 of the coating apparatus 44*b*. The full width web Wb emerging from the first section 64 is dumped into a second broke chute 66. A third tail is cut from the full width web by a second cutter 67 between the first section 64 and the second broke chute 66 in the same manner as when cutting the second tail 42*b*. This third tail is fed at coating velocity Vc through a downstream second section 68 of the coating apparatus 44*b*.

A coater for carrying out the operational method shown in FIGS. 2 to 17 includes an unwind stand for unwinding the web to be coated, and a pull stack disposed downstream relative to the unwind stand. A first broke chute is disposed below the pull stack such that when a first tail has been threaded through the pull stack and the first tail has been widened to provide a full width web extending through the pull stack the full width web emerging from the pull stack is dumped into the first broke chute. A coating apparatus for coating the web is accelerated along with the unwind stand, the pull stack and the full width web to coating velocity such that the web being dumped to the first broke chute attains the same coating velocity as the coating apparatus. A first cutter is disposed between the unwind stand and the pull stack for cutting a second tail from the full width web emerging from the pull stack such that the second tail is fed through the coating apparatus at coating velocity. The first cutter moves relative to the web upstream relative to the coating apparatus so that the second tail is widened enabling a full width web to extend through the coating apparatus at coating velocity. This arrangement avoids the necessity of threading the web at threading velocity through the coating apparatus subsequent to a web breakage. By use of this apparatus in the aforementioned manner, the inherent loss of production associated with such threading at threading velocity is inhibited.

By utilizing the arrangement illustrated herein, the papermaking machine can run completely independently of the coater and the coater can run at essentially the same speed as the papermaking machine and pull or cull poor paper ahead of the coater.

By way of example, with a coater operating at 4,000 feet per minute, the constant run on-machine coater can have 8 breaks per day and produce 738 tons per day on reel.

However, the corresponding off-machine coater arrangement of the prior art proposals would only produce 624 tons per day. From this, it is evident that the on-machine coater is 18 percent more productive than the corresponding off-machine coater. In practice, this would mean that with an on-machine coater, the web would be coated at 3,891 feet per minute whereas with the off-machine coater the average production of paper would have to be slowed down to 3,527 feet per minute.

From the foregoing, it will be evident to those skilled in the art that by providing the broke chutes and method of operating the coater as set forth hereinbefore, the downtime necessitated by threading and rethreading the second tail at low threading velocities can be greatly reduced by applying the teaching of the present invention. Not only does the arrangement of the present invention save downtime when starting a coating operation but, more particularly, greater savings will be achieved when handling situations involving a multiplicity of web breakages.

What is claimed is:

1. A method of operating a coater which comprises the sequential steps of:
   - separating a first tail from a full width web unwound from an unwind stand at threading velocity;
   - threading the first tail at the threading velocity through a pull stack;
   - widening the first tail to the full width of the web so that a full width web extends through the pull stack;
   - dumping the full width web emerging from the pull stack into a first broke chute disposed below the pull stack;
   - accelerating the full width web extending through the pull stack and accelerating a coating apparatus to coating velocity so that both the full width web and the coating apparatus attain coating velocity;
   - cutting a second tail in the full width web between the unwind stand and the pull stack;
   - threading the second tail emerging from the pull stack through the coating apparatus while the second tail is moving at coating velocity and while continuing to dispose of the full width web less the second tail into the first broke chute;
   - widening the second tail to full width so that a full width web extends through the coating apparatus;
   - coating the full width web during passage through the coating apparatus; and
   - reeling the coated web onto a windup reel.

2. A method as set forth in claim 1 wherein the step of separating the first tail further includes:
   - manually tearing a first narrow tail portion from the full width web being unwound on the unwind stand, the first narrow tail having first and second side edges disposed parallel relative to each other and extending in a machine direction for facilitating threading of the first tail through the pull stack.

3. A method as set forth in claim 2 wherein the step of threading the first tail further includes:
   - inserting the first narrow portion of the first tail into a first nip defined by cooperating rolls of the pull stack such that when the cooperating rolls of the pull stack are rotating at threading velocity, the first narrow tail portion is threaded through the pull stack 4. A method as set forth in claim 2 wherein the step of widening the first tail further includes:

widening the first narrow tail portion progressively until a full width web extends through the pull stack, the first widening portion of the first tail being disposed between the first narrow tail portion and the full width web.

5. A method as set forth in claim 1 wherein the step of dumping the full width web further includes:

returning the dumped web for repulping.

6. A method as set forth in claim 1 wherein the step of accelerating the full width web further includes:

accelerating the unwind stand and the pull stack such that the full width web emerging from the pull stack and being dumped is accelerated rapidly to coating velocity;

accelerating the coating apparatus rapidly to coating velocity so that the coating apparatus attains a coating velocity which is the same velocity as that of the full width web being dumped.

7. A method as set forth in claim 1 wherein the step of cutting the second tail further includes:

operating a first cutter disposed between the unwind stand and the pull stack such that the first cutter cuts a second narrow tail portion from the full width web being dumped, the second narrow tail portion having laterally spaced, parallel third and fourth edges for facilitating threading of the second narrow tail portion into the coating apparatus.

8. A method as set forth in claim 1 wherein the step of threading the second tail further includes:

feeding the second tail between cooperating threading ropes of the coating apparatus such that the second tail which is generated between the pull stack and the first broke chute at coating velocity is fed between the rope and threaded at coating velocity through the coating apparatus, the second tail being fed through the coating apparatus while the full width web less the second tail is dumped into the first broke chute.

9. A method as set forth in claim 7 wherein the step of widening the second tail further includes:

moving the first cutter in a cross-machine direction such that as the full width web moves relative to the first cutter, the second narrow tail portion progressively widens until a full width web extends through the coating apparatus, the third edge of the second widening portion being disposed in a machine direction and a fifth edge being disposed diagonally relative to the third edge and with the second widening portion being disposed between the second narrow tail portion and the full width web.

10. A method as set forth in claim 9 wherein the step of widening the second tail further includes:

moving the first cutter in a cross-machine direction such that the second narrow tail portion progressively widens until a full width web extends through a first section of the coating apparatus;

dumping the full width web emerging from the first section into a second broke chute;

cutting a third tail from the full width web between the first section and the second broke chute;

feeding the third tail at coating velocity through a downstream second section of the coating apparatus.

* * * * *